US011315708B1

(12) United States Patent
Park et al.

(10) Patent No.: US 11,315,708 B1
(45) Date of Patent: Apr. 26, 2022

(54) CHIP RESISTOR

(71) Applicant: SAMSUNG ELECTRO-MECHANICS CO., LTD., Suwon-si (KR)

(72) Inventors: Kwang Hyun Park, Suwon-si (KR); Ah Ra Cho, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 17/182,681

(22) Filed: Feb. 23, 2021

(30) Foreign Application Priority Data

Nov. 30, 2020 (KR) ..... 10-2020-0163919

(51) Int. Cl.
*H01C 1/142* (2006.01)
*H01C 7/00* (2006.01)

(52) U.S. Cl.
CPC ..... *H01C 1/142* (2013.01); *H01C 7/003* (2013.01)

(58) Field of Classification Search
CPC ..... H01C 1/142; H01C 17/22; H01C 17/242
See application file for complete search history.

(56) References Cited

U.S. PATENT DOCUMENTS 4,146,867 A * 3/1979 Blangeard ..... H01C 7/22 338/195
4,377,944 A * 3/1983 Hishii ..... G01N 27/12 338/34
4,929,923 A * 5/1990 Dharmadhikari ..... H01C 17/24 219/121.68
6,005,474 A * 12/1999 Takeuchi ..... H01C 17/006 338/320
6,060,760 A * 5/2000 Tan ..... H01L 27/0802 257/536
6,359,546 B1 * 3/2002 Oh ..... H01C 1/148 338/313
7,485,933 B2 * 2/2009 Harada ..... H01L 27/0802 257/380

(Continued)

FOREIGN PATENT DOCUMENTS

JP 2019-079963 A 5/2019

OTHER PUBLICATIONS

JP2019079963 (Same as WO2019082523) machine translation of the Description. (Year: 2019).*

*Primary Examiner* — Kyung S Lee
(74) *Attorney, Agent, or Firm* — Morgan, Lewis & Bockius LLP

(57) ABSTRACT

A chip resistor includes: an insulating substrate; a resistor portion disposed on one surface of the insulating substrate and including a plurality of resistor bodies spaced apart from each other and a plurality of internal electrodes connecting the plurality of resistor bodies to each other; and a first external electrode and a second external electrode disposed on the one surface of the insulating substrate to be spaced apart from each other and respectively connected to the resistor portion, wherein each of the plurality of resistor bodies has a first end adjacent to the first external electrode and a second end opposing the first end and adjacent to the second external electrode, and each of the first end and the second end of each of the plurality of resistor bodies is connected to one of the plurality of internal electrodes, the first external electrode, or the second external electrode.

20 Claims, 7 Drawing Sheets

(56) References Cited

U.S. PATENT DOCUMENTS

| | | | | |
|---|---|---|---|---|
| 7,733,211 | B2 * | 6/2010 | Yoneda | H01C 1/148<br>338/307 |
| 9,691,838 | B1 * | 6/2017 | Han | H01L 28/20 |
| 9,960,116 | B2 * | 5/2018 | Ohshima | H01L 23/5228 |

* cited by examiner

CHIP RESISTOR

CROSS-REFERENCE TO RELATED APPLICATION(S)

The present application claims the benefit of priority to Korean Patent Application No. 10-2020-0163919, filed on Nov. 30, 2020 in the Korean Intellectual Property Office, the disclosure of which is incorporated herein by reference in its entirety.

TECHNICAL FIELD

The present disclosure relates to a chip resistor.

BACKGROUND

In accordance with the miniaturization and implementation of high functionality in an electronic device, a technology for a chip resistor has also been developed in line with the trend for high power, high precision, ultra-low resistance, and microminiaturization. Meanwhile, in a high-power product for realizing higher power in a chip having the same size, there is a case in which a serpentine cut is formed in a resistor body through a laser trimming process in order to improve power characteristics. In this case, there is a problem that heat may be generated due to concentration of a current on the resistor body disposed in a trimming end region.

SUMMARY

An aspect of the present disclosure may provide a chip resistor having excellent heat dissipation properties and resistance to thermal shock.

Another aspect of the present disclosure may provide a chip resistor having improved electrical characteristics.

According to an aspect of the present disclosure, a chip resistor may include: an insulating substrate; a resistor portion disposed on one surface of the insulating substrate, and including a plurality of resistor bodies spaced apart from each other and a plurality of internal electrodes connecting the plurality of resistor bodies to each other; and a first external electrode and a second external electrode disposed on the one surface of the insulating substrate to be spaced apart from each other and respectively connected to the resistor portion, wherein each of the plurality of resistor bodies has a first end adjacent to the first external electrode and a second end opposing the first end and adjacent to the second external electrode, and each of the first end and the second end of each of the plurality of resistor bodies is connected to one of the plurality of internal electrodes, the first external electrode, or the second external electrode.

According to another aspect of the present disclosure, a chip resistor may include: an insulating substrate; an insulating substrate; a resistor portion disposed on one surface of the insulating substrate, and including a plurality of resistor bodies spaced apart from each other and a plurality of internal electrodes connecting the plurality of resistor bodies to each other; and a first external electrode and a second external electrode disposed on the one surface of the insulating substrate to be spaced apart from each other and respectively connected to the resistor portion, wherein each of the plurality of internal electrodes covers parts of the plurality of resistor bodies.

According to still another aspect of the present disclosure, a chip resistor may include: an insulating substrate; a resistor portion disposed on one surface of the insulating substrate, and including a plurality of resistor bodies spaced apart from each other in a width direction and a plurality of internal electrodes each connecting adjacent resistor bodies of the plurality of resistor bodies to each other; and a first external electrode and a second external electrode disposed on the one surface of the insulating substrate and connected to two outermost resistor bodies of the plurality of resistor bodies, respectively, in a length direction perpendicular to the width direction, wherein the first external electrode and the second external electrode extend in opposite directions, parallel to the length direction, from respective ends of the two outermost resistor bodies, and further extend in opposite directions, parallel to the width direction, along opposing edges of the insulating substrate, such that the first external electrode and the second external electrode overlap the plurality of internal electrodes in the length direction.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
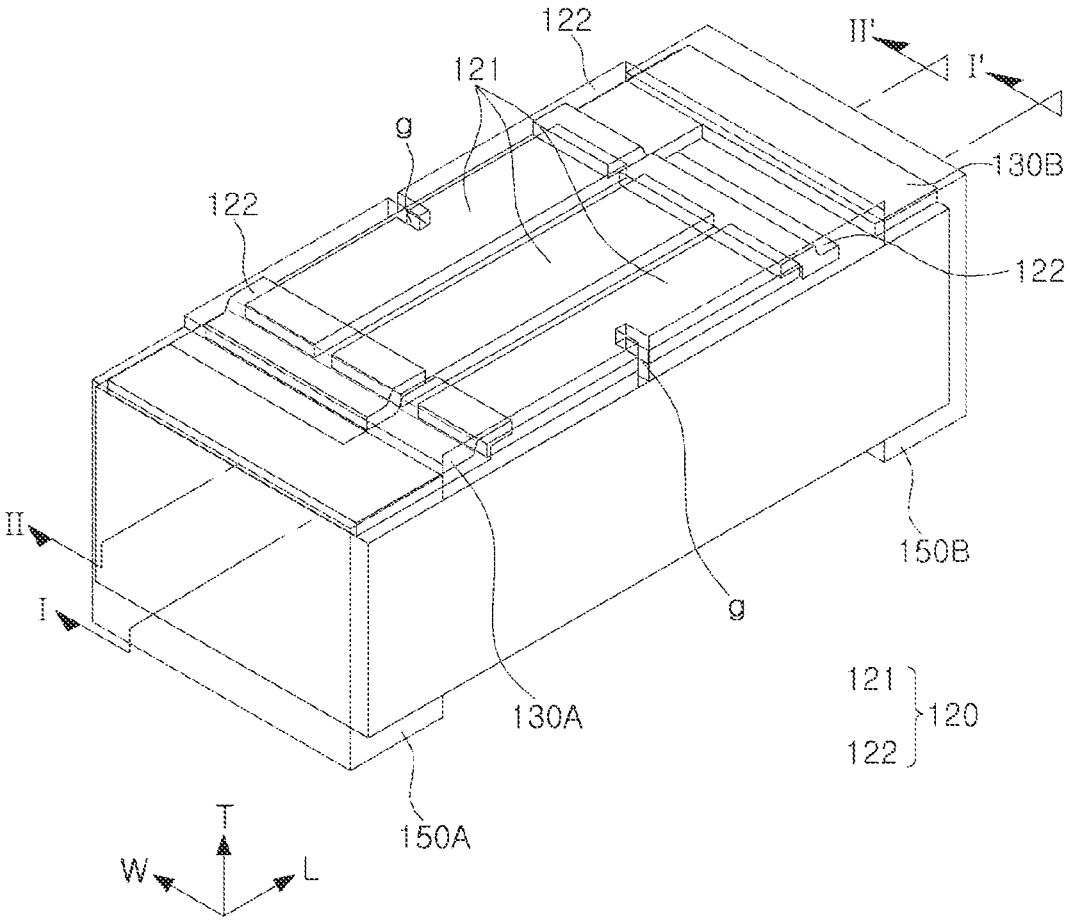
FIG. 1 is a schematic perspective view illustrating a chip resistor according to the present disclosure.

Hereinafter, exemplary embodiments of the present disclosure will now be described in detail with reference to the accompanying drawings.

In addition, herein, the meaning that a component is formed on another component is that a component is formed on another component with the other component interposed therebetween as well as a component is in direct contact with and formed on another component.

Further, herein, end portions may refer to end parts opposing each other, and may refer to a first end or a second end opposing the first end, or refer to one end and the other end. In this case, a region expressed as one end in any description may be expressed as the other end in another description. Similarly, a region expressed as the other end in any description may be expressed as one end in another description.

A "connection" of a component to another component herein conceptually includes an indirect connection through a third component as well as a direct connection between two components. In addition, "electrically connected" conceptually includes a physical connection and a physical disconnection.

Terms "first", "second", and the like, herein are used to distinguish one component from another component, and do not limit a sequence, importance, and the like, of the corresponding components. In some cases, a first element may be referred to as a second element. Similarly, a second element may also be referred to as a first element.

The term "an exemplary embodiment" used herein does not refer to the same exemplary embodiment, and is used to emphasize a particular feature or characteristic different from that of another exemplary embodiment. However, exemplary embodiments provided herein are considered to be able to be implemented by being combined in whole or in part one with one another. For example, one element described in a particular exemplary embodiment, even if it is not described in another exemplary embodiment, may be understood as a description related to another exemplary embodiment, unless an opposite or contradictory description is provided therein.

Terms used herein are used only in order to describe an exemplary embodiment rather than limiting the present disclosure. In this case, singular forms include plural forms unless interpreted otherwise in context.

Hereinafter, exemplary embodiments in the present disclosure will be described with reference to the accompanying drawings. In the drawings, shapes, sizes, and the like, of respective components may be exaggerated or shortened for clarity.

Chip Resistor

FIG. 1 is a schematic perspective view illustrating a chip resistor according to the present disclosure.

Figure 2:
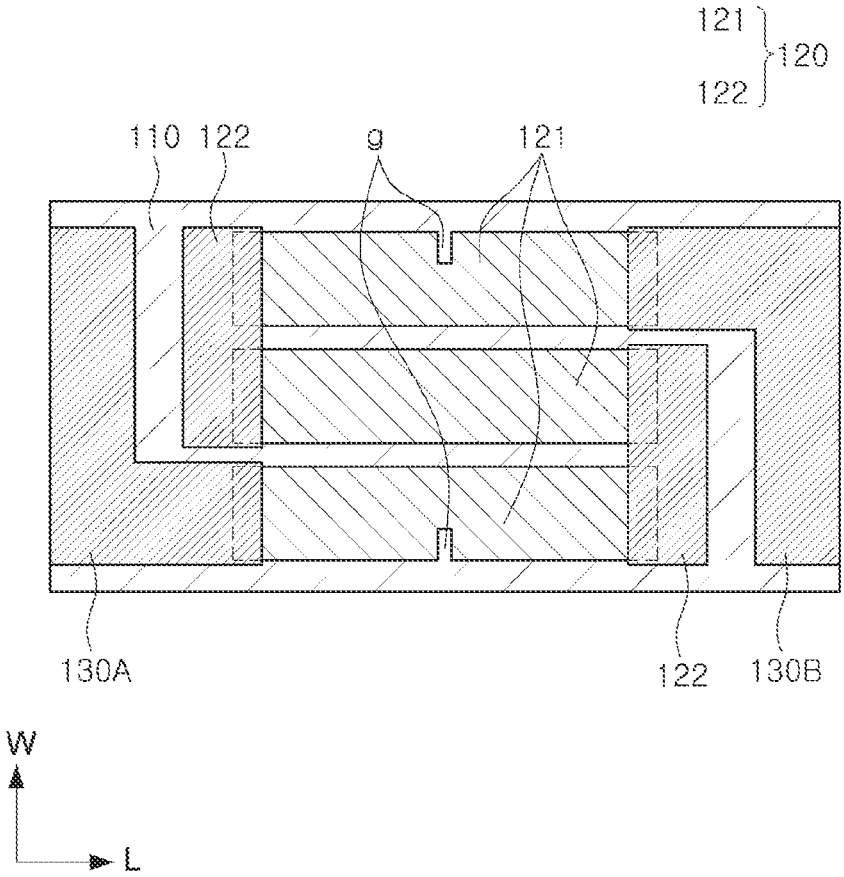
FIG. 2 is a plan view illustrating the chip resistor of FIG. 1 when viewed from one surface of an insulating substrate.

FIG. 2 is a plan view illustrating the chip resistor of FIG. 1 when viewed from one surface of an insulating substrate.

Figure 3:
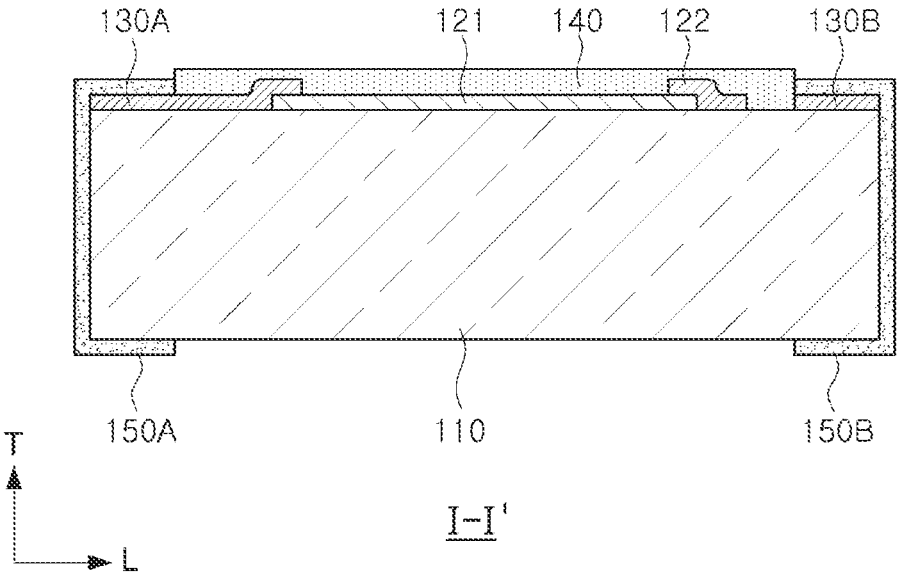
FIG. 3 is a cross-sectional view taken along line I-I' of the chip resistor of FIG. 1.

FIG. 3 is a cross-sectional view taken along line I-I' of the chip resistor of FIG. 1.

Figure 4:
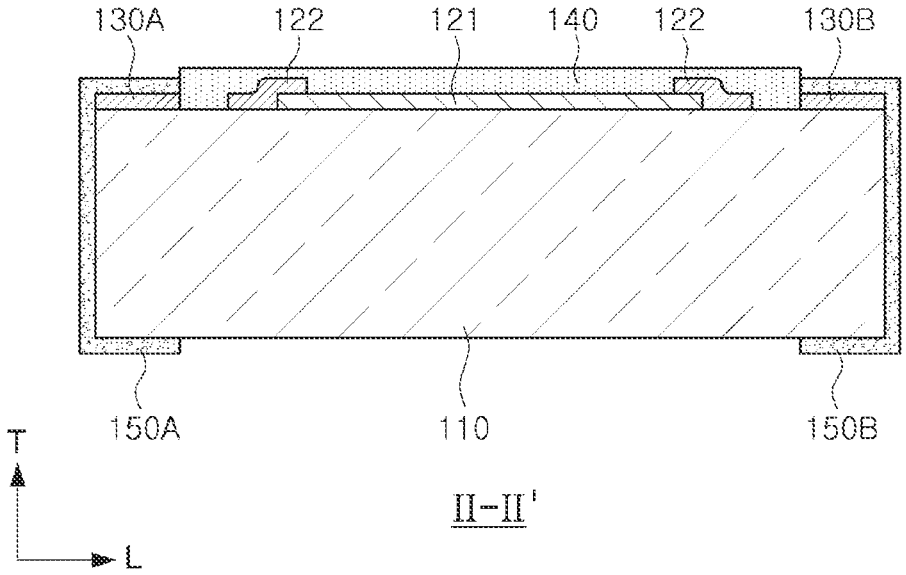
FIG. 4 is a cross-sectional view taken along line II-II' of the chip resistor of FIG. 1.

FIG. 4 is a cross-sectional view taken along line II-II' of the chip resistor of FIG. 1.

Referring to FIGS. 1 through 4, the chip resistor according to the present disclosure may include an insulating substrate 110, a resistor portion 120 disposed on one surface of the insulating substrate 110 and including a plurality of resistor bodies 121 spaced apart from each other and a plurality of internal electrodes 122 connecting the plurality of resistor bodies 121 to each other, and a first external electrode 130A and a second external electrode 130B disposed on one surface of the insulating substrate 110 to be spaced apart from each other and respectively connected to the resistor bodies 121. In addition, the chip resistor may further include at least one of a protective layer 140, a first cover electrode 150A, and a second cover electrode 150B.

The insulating substrate 110 may serve to support the resistor portion 120 and secure strength of the chip resistor.

The insulating substrate 110 may have both end surfaces opposing each other in a length direction L, both side surfaces opposing each other in a width direction W perpendicular to the length direction L, and one surface and the other surface opposing each other in a thickness direction T perpendicular to each of the length direction L and the width direction W. The insulating substrate 110 may have a rectangular parallelepiped shape or a plate shape as a whole, but is not limited thereto.

A material for forming the insulating substrate 110 is not particularly limited, and may be a material having an excellent insulation property, heat dissipation property, and adhesion property to the resistor body 121. For example, the insulating substrate 110 may be formed of a ceramic material such as alumina ($Al_2O_3$).

The resistor portion 120 may be disposed on one surface of the insulating substrate 110, and may include the resistor bodies 121 and the internal electrodes 122. The resistor portion 120 may electrically connect the first external electrode 130A and the second external electrode 130B to each other.

The chip resistor according to the present disclosure may include the plurality of resistor bodies 121. The number of resistor bodies 121 is not particularly limited, and may be more than that illustrated in the drawings or be less than that illustrated in the drawings.

In this case, as illustrated in the drawings, the plurality of resistor bodies 121 may be spaced apart from each other in the width direction W perpendicular to the length direction L from the first external electrode 130A toward the second external electrode 130B. It has been illustrated in the drawings that the plurality of resistor bodies 121 are disposed in parallel with each other, but the plurality of resistor bodies 121 are not limited thereto. In addition, according to a design, the plurality of resistor bodies 121 may be spaced apart from each other in the length direction L from the first external electrode 130A toward the second external electrode 130B.

Each of the plurality of resistor bodies 121 may have a first end adjacent to the first external electrode 130A and a second end opposing one first and adjacent to the second external electrode 130B. the first end and the second end of each of the plurality of resistor bodies 121 may oppose each other in the length direction L. Each of the plurality of resistor bodies 121 may be disposed in a region between the first external electrode 130A and the second external electrode 130B. However, the plurality of resistor bodies 121 may have regions overlapping each other for connection with the first external electrode 130A and the second external electrode 130B.

Each of the first end and the second end of each of the plurality of resistor bodies 121 may be connected to one of the internal electrode 122, the first external electrode 130A, and the second external electrode 130B. In this case, each of the first end and the second end of each of the plurality of resistor bodies 121 may be covered with one of the internal electrode 122, the first external electrode 130A, and the second external electrode 130B to be connected to one of the internal electrode 122, the first external electrode 130A, and the second external electrode 130B.

Resistor bodies 121 disposed on the outermost sides in the width direction W among the plurality of resistor bodies 121 may be connected to the first external electrode 130A or the second external electrode 130B. Specifically, one of two resistor bodies 121 disposed on the outermost sides in the width direction W and facing each other in the width direction W may be connected to the first external electrode 130A, and the other of the two resistor bodies 121 may be connected to the second external electrode 130B. For example, the first end of one of two resistor bodies 121 disposed on the outermost sides in the width direction Wand facing each other in the width direction W may be connected to the first external electrode 130A, and the second end of the other of the two resistor bodies 121 may be connected to the second external electrode 130B. Therefore, the resistor portion 120 may be connected to the first external electrode 130A and the second external electrode 130B through the resistor bodies 121 disposed on the outermost sides.

In addition, the first end and the second end of each of resistor bodies 121 other than the resistor bodies 121 disposed on the outermost sides among the plurality of resistor bodies 121 may be connected to the internal electrodes 122. Specifically, the first end and the second end of each of resistor bodies 121 other than the resistor bodies 121 disposed on the outermost sides among the plurality of resistor bodies 121 may be connected, respectively, to the internal electrodes 122 distinguished from each other among the plurality of internal electrodes 122. Therefore, the plurality of resistor bodies 121 may be connected to each other through the plurality of internal electrodes 122 to constitute the resistor portion 120 functioning as one resistor element together with the plurality of internal electrodes 122. However, each of the first end and the second end of one resistor body 121 may be connected to a different resistor body 121 and may not be connected to the same resistor body 121.

A material including at least one of lead (Pd), silver (Ag), ruthenium (Ru), copper (Cu), nickel (Ni), and silicon (Si) may be used as a material for forming the resistor body 121. For example, the resistor body 121 may be formed by printing a paste for forming the resistor body in which at least one of silica ($SiO_2$), ruthenium oxide ($RuO_2$), a copper-nickel (CuNi) alloy, and $Pb_2Ru_2O_{6.5}$ is dispersed in a resin on the insulating substrate 110 and then sintering the printed paste for the resistor body.

In addition, the material for forming the resistor body 121 may further include a glass component, and the resistor body 121 may be formed by, for example, printing the paste for forming the resistor body further including glass and then sintering the printed paste for forming the resistor body.

However, the method of forming the resistor body 121 is not limited thereto, and the resistor body 121 may be formed through a sputtering process or the like.

Meanwhile, at least one of the plurality of resistor bodies 121 may have a groove g. The groove g may serve to adjust a resistance value of the resistor portion 120.

The groove g may be formed through a trimming process, and the resistance value of the resistor portion 120 may be finely adjusted through the groove. Specifically, the trimming process may be performed in a manner of measuring the resistance value of the resistor portion 120 while forming the groove g in the resistor body 121 by laser machining or the like, and stopping the formation of the groove g when the resistance value reaches a target resistance value.

Each of the plurality of resistor bodies 121 may have the groove g, and only some of the plurality of resistor bodies 121 may have the groove g. The number, shapes, positions, and the like, of grooves g formed in each of the plurality of resistor bodies 121 may be the same as or be different from each other. It has been illustrated in the drawings that the groove g is formed in a single number only in the resistor bodies 121 disposed on the outermost sides among the plurality of resistor bodies 121, but the number, shapes, positions, and the like, of grooves g are not limited to those illustrated in the drawings.

The groove g may be formed from an edge of the resistor body 121 inwardly of the resistor body 121. For example, the groove g may be formed from an edge of at least one of surfaces of the resistor body 121 opposing each other in the width direction W inwardly of the resistor body 121 in the width direction W. The groove g may penetrate through the resistor body 121 in the thickness direction T, and may not penetrate through the resistor body 121 in the length direction L and the width direction W.

Each of the plurality of internal electrodes 122 may cover parts of the plurality of resistor bodies 121. In this case, each of the plurality of internal electrodes 122 may cover end portions of the plurality of resistor bodies 121.

Each of the plurality of internal electrodes 122 may be spaced apart from each of the first external electrode 130A and the second external electrode 130B. Therefore, each of the plurality of internal electrodes 122 may be indirectly connected to the first external electrode 130A and the second external electrode 130B through the resistor body 121.

The internal electrode 122 may integrally cover end portions of each of resistor bodies 121 neighboring to each other among the plurality of resistor bodies 121 to connect between the neighboring resistor bodies 121 to each other. For example, the internal electrode 122 may integrally cover the first ends of each of the resistor bodies 121 neighboring to each other in the width direction W among the plurality of resistor bodies 121. In this case, the internal electrode 122 may cover the first end of any one of the plurality of resistor bodies 121, and may extend in the width direction W to further cover the first end of a resistor body 121 adjacent to the resistor body 121 covered by the internal electrode 122. In addition, the internal electrode 122 may cover an end portion of the resistor body 121 and may further cover a part of the insulating substrate 110.

Unlike illustrated in the drawings, when the plurality of resistor bodies 121 are spaced apart from each other in the length direction (L), the internal electrode 122 may integrally cover end portions of each of resistor bodies 121 neighboring to each other in the length direction L among the plurality of resistor bodies 121. In this case, the internal electrode 122 may cover the first end of any one of the plurality of resistor bodies 121, and may extend in the length direction L to further cover the first end of a resistor body 121 adjacent to the resistor body 121 covered by the internal electrode 122.

The internal electrode 122 may be disposed in a region between the first external electrode 130A and the resistor body 121 or a region between the second external electrode 130B and the resistor body 121. However, the internal electrode 122 may have a region overlapping at least one of the resistor body 121, the first external electrode 130A, and the second external electrode 130B.

It may be advantageous to use a material having excellent heat dissipation properties and resistance to thermal shock as a material for forming the internal electrode 122. For example, the internal electrode 122 may be formed by printing a conductive paste including at least one of silver (Ag), a silver-palladium (Ag—Pd) alloy, and copper (Cu) on the insulating substrate 110 and the resistor body 121 and then sintering the printed conductive paste.

The internal electrode 122 may include the same material as that of at least one of the first external electrode 130A and the second external electrode 130B. The internal electrode 122 may be formed together with the first external electrode 130A and the second external electrode 130B in the same process as that of the first external electrode 130A and the second external electrode 130B. In this case, it may be advantageous for convenience of a process to form the internal electrode 122 using the same material as that of each of the first external electrode 130A and the second external electrode 130B. However, the internal electrode 122 may include a material different from that of at least one of the first external electrode 130A and the second external electrode 130B.

The resistor portion 120 may have a structure in which the resistor bodies 121 and the internal electrodes 122 are alternately disposed. In this case, the resistor bodies 121 and the internal electrodes 122 may be alternately disposed in a direction perpendicular to each other while respective end portions thereof overlap each other. Therefore, the resistor body 121 and the internal electrodes 122 may be alternately connected to each other, such that the resistor portion 120 may have a zigzag shape, an S shape and the like as a whole. However, the resistor bodies 121 and the internal electrodes 122 do not necessarily need to be disposed in the direction perpendicular to each other.

A current transferred to the resistor portion 120 through the first external electrode 130A may pass alternately through the resistor bodies 121 and the internal electrodes 122 and be then transferred to the second external electrode 130B. Alternatively, a current transferred to the resistor portion 120 through the second external electrode 130B may pass alternately through the resistor bodies 121 and the internal electrodes 122 and be then transferred to the first external electrode 130A. For example, when the current is transmitted to the resistor portion 120 through the first external electrode 130A, the transferred current may pass through the resistor body 121, the internal electrode 122, the resistor body 121, the internal electrode 122, and the resistor body 121, and be then transferred to the second external electrode 130B.

Alternatively, when the current is transmitted to the resistor portion 120 through the second external electrode 130B, the transferred current may pass through the resistor body 121, the internal electrode 122, the resistor body 121, the internal electrode 122, and the resistor body 121, and be then transferred to the first external electrode 130A.

The first external electrode 130A and the second external electrode 130B may be disposed on one surface of the insulating substrate 110 to be spaced apart from each other, and may be each connected to the resistor bodies 121. In this case, each of the first external electrode 130A and the second external electrodes 130B may electrically connect the resistor bodies 121 to each of first and second cover electrodes 150A and 150B to be described later.

The first external electrode 130A and the second external electrode 130B may be disposed on one surface of the insulating substrate 110 so as to face each other in the length direction L. In addition, the first external electrode 130A and the second external electrode 130B may be disposed on the outermost sides in the length direction L on one surface of the insulating substrate 110.

Each of the first external electrode 130A and the second external electrode 130B may extend to each of corners formed by one surface of the insulating substrate 110 and both end surfaces of the insulating substrate 110 opposing each other in the length direction L, but is not limited thereto. Each of the first external electrode 130A and the second external electrode 130B may extend to each of corners formed by one surface of the insulating substrate 110 and both side surfaces of the insulating substrate 110 opposing each other in the width direction W, but is not limited thereto.

Each of the first external electrode 130A and the second external electrode 130B may be formed by printing a conductive paste including at least one of silver (Ag), a silver-palladium (Ag—Pd) alloy, and copper (Cu) on the insulating substrate 110 and the resistor body 121 and then sintering the printed conductive paste.

At least one of the first external electrode 130A and the second external electrode 130B may include the same material as that of the internal electrode 122. The first external electrode 130A and the second external electrode 130B may be formed together with the internal electrode 122 in the same process as that of the internal electrode 122. In this case, it may be advantageous for convenience of a process to form each of the first external electrode 130A and the second external electrode 130B using the same material as that of the internal electrode 122. However, at least one of the first external electrode 130A and the second external electrode 130B may include a material different from that of the internal electrode 122.

The protective layer 140 may be disposed on the resistor portion 120 to serve to protect the resistor portion 120. In addition, the protective layer 140 may serve to significantly reduce damage to the resistor body 121 in the trimming process.

The protective layer 140 may be disposed in a region between the first external electrode 130A and the second external electrode 130B, and may cover parts of each of the first external electrode 130A and the second external electrode 130B according to a design.

At least one of silica ($SiO_2$), epoxy, a phenol resin, and glass may be used as a material for forming the protective layer 140.

Meanwhile, the groove g may extend to the protective layer 140 so as to penetrate the protective layer 140. The reason is that the groove g is formed so as to penetrate both of the resistor body 121 and the protective layer 140 together after the protective layer 140 is disposed on the resistor portion 120, as described later.

The groove g may be formed from an edge of the protective layer 140 inwardly of the protective layer 140. For example, the groove g may be formed from an edge of at least one of surfaces of the protective layer 140 opposing each other in the width direction W inwardly of the protective layer 140 in the width direction W. The groove g may penetrate through the protective layer 140 in the thickness direction T, and may not penetrate through the protective layer 140 in the length direction L and the width direction W.

However, the protective layer 140 may be formed in a region wider than that of the resistor body 121, and thus, the groove g of the protective layer 140 may have a shape in which the groove g of the resistor body 121 extends. For example, the groove g of the protective layer 140 may have a shape in which the groove g of the resistor body 121 extends in the width direction W.

It has been illustrated in the drawings that a thickness of the protective layer 140 on one surface of the insulating substrate 110 is greater than that of each of the first cover electrode 150A and the second cover electrode 150B, but the thickness of the protective layer 140 is not limited thereto. According to a design, in order to easily connect the first cover electrode 150A and the second cover electrode 150B to a mounting substrate, the thickness of the protective layer 140 on one surface of the insulating substrate 110 may be smaller than that of each of the first cover electrode 150A and the second cover electrode 150B.

Each of the first cover electrode 150A and the second cover electrode 150B is connected to each of the first external electrode 130A and the second external electrode 130B.

The first cover electrode 150A and the second cover electrode 150B may be disposed on end portions of the insulating substrate 110, respectively, to be spaced apart from each other. For example, each of the first cover electrode 150A and the second cover electrode 150B may be disposed on each of both end surfaces of the insulating substrate 110 and extend onto one surface and the other surface of the insulating substrate 110 to have a 'U' shape.

A material for forming each of the first cover electrode 150A and the second cover electrode 150B may include at least one of nickel (Ni), tin (Sn), copper (Cu), and chromium (Cr). Each of the first cover electrode 150A and the second cover electrode 150B may include one or more metal layers. For example, each of the first cover electrode 150A and the second cover electrode 150B may have a triple metal layer structure in which a nickel (Ni) plating layer and a tin (Sn) plating layer are sequentially disposed on a copper (Cu) plating layer.

Meanwhile, in a high-power product for realizing higher power in a chip having the same size, there is a case where a serpentine cut is formed in a resistor body through a laser trimming process in order to improve power characteristics. In this case, there is a problem that heat is generated due to concentration of a current on the resistor body disposed in a trimming end region.

In the chip resistor according to the present disclosure, the resistor portion 120 in which the plurality of resistor bodies 121 are connected to each other by the internal electrodes 122 having excellent heat dissipation properties and resistance to thermal shock may be provided instead of a single resistor body in which the serpentine cut is formed through the trimming process. The chip resistor capable of efficiently dissipating heat generated due to current concentration through the internal electrodes and resistance to the thermal shock may be provided. As a result, the chip resistor having improved power characteristics in the same size may be provided.

FIGS. 5A through 5E are views for describing a manufacturing process of the chip resistor according to the present disclosure.

Figure 5A:
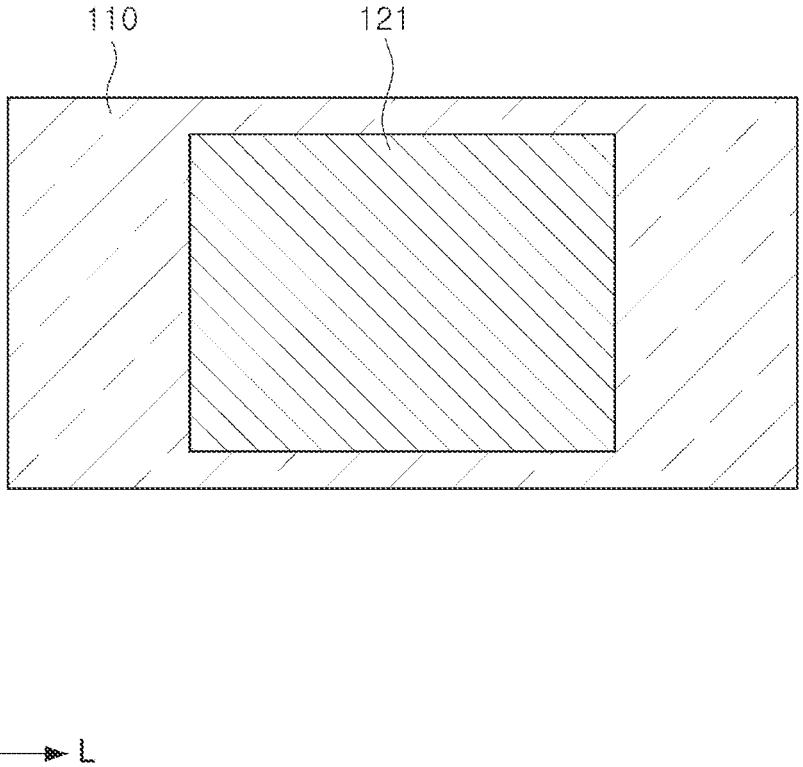
FIGS. 5A through 5E are views for describing a manufacturing process of the chip resistor according to the present disclosure.

Referring to FIG. 5A, the resistor body 121 may be formed on the insulating substrate 110. The resistor body 121 may be formed by printing a paste for forming the resistor body in which at least one of silica ($SiO_2$), ruthenium oxide ($RuO_2$), a copper-nickel (CuNi) alloy, and $Pb_2Ru_2O_{6.5}$ is dispersed in a resin on the insulating substrate 110 and then sintering the printed paste for the resistor body. Alternatively, the resistor body 121 may be formed by printing the paste for forming the resistor body further including glass and the sintering the printed paste for forming the resistor body. In this case, the resistor body 121 may exist as a single resistor body 121 that is not spaced apart from each other on the insulating substrate 110.

Figure 5B:
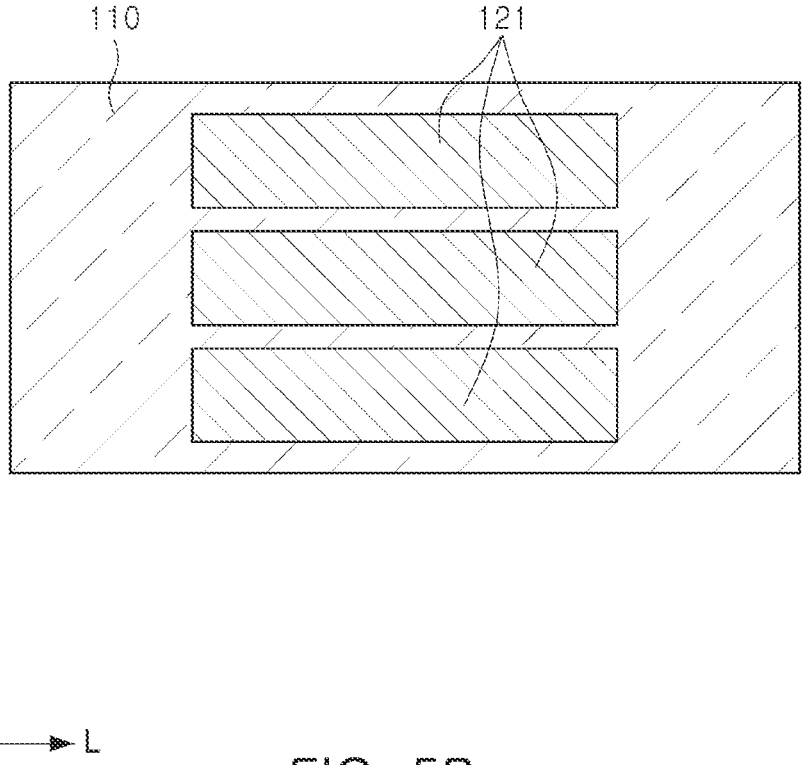

Next, referring to FIG. 5B, the resistor body 121 may be separated into a plurality of resistor bodies 121 spaced apart from each other. In this case, the resistor body 121 may be separated into the plurality of resistor bodies by removing parts of the resistor body 121 with a laser beam. The process of separating the resistor body 121 into the plurality of resistor bodies 121 with the laser beam may be performed in a manner of executing, plural times, a process of exposing the insulating substrate 110 by laser-machining the resistor body 121 along the length direction L from the first end of the resistor body 121 to the second end of the resistor body 121.

Alternatively, the process of separating the resistor body 121 into the plurality of resistor bodies 121 with the laser beam may be performed between a process of printing the paste for forming the resistor body and a process of sintering the printed paste for the resistor body, unlike described above, but is not limited thereto.

Figure 5C:
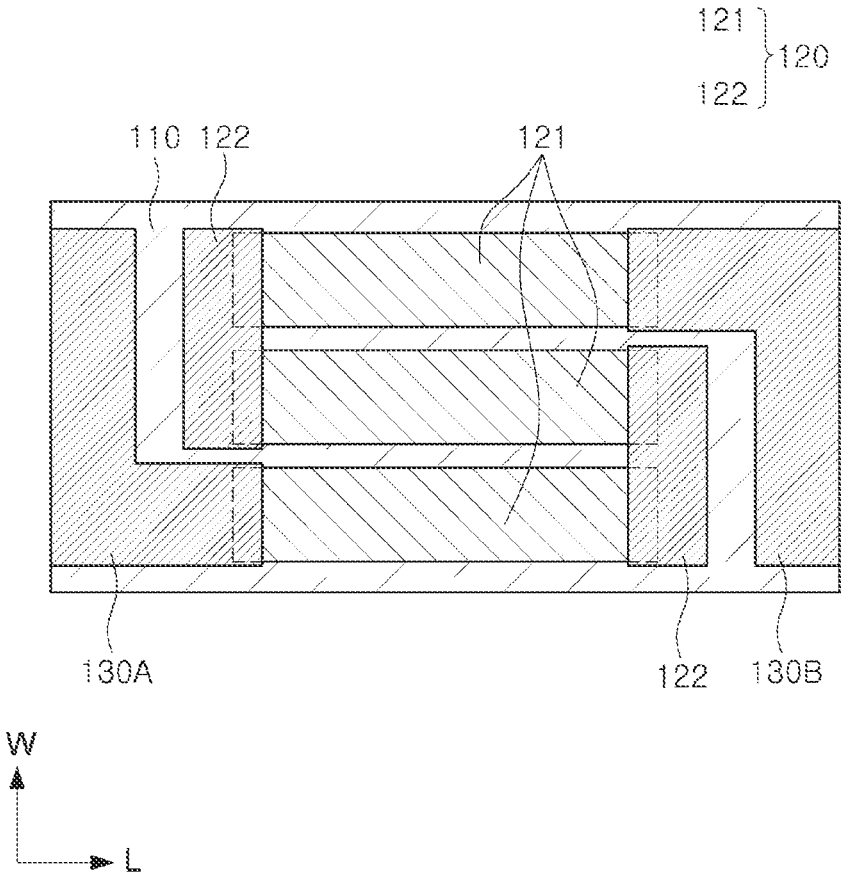

Next, referring to FIG. 5C, the internal electrodes 122 and the external electrodes 130A and 130B connected to the resistor bodies 121. Each of the internal electrodes 122 and the external electrodes 130A and 130B may be formed by printing a conductive paste including at least one of silver (Ag), a silver-palladium (Ag—Pd) alloy, and copper (Cu) on the insulating substrate 110 and the resistor body 121 and then sintering the printed conductive paste. The internal electrodes 122 and the external electrodes 130A and 130B may be formed in the same process, but may be formed separately from each other. The internal electrode 122 may integrally cover the end portions of the resistor bodies 121 adjacent to each other among the plurality of resistor bodies 121, and the external electrodes 130A and 130B may cover the end portions of the resistor bodies 121 disposed on the outermost sides in the width direction W among the plurality of resistor bodies 121.

Figure 5D:
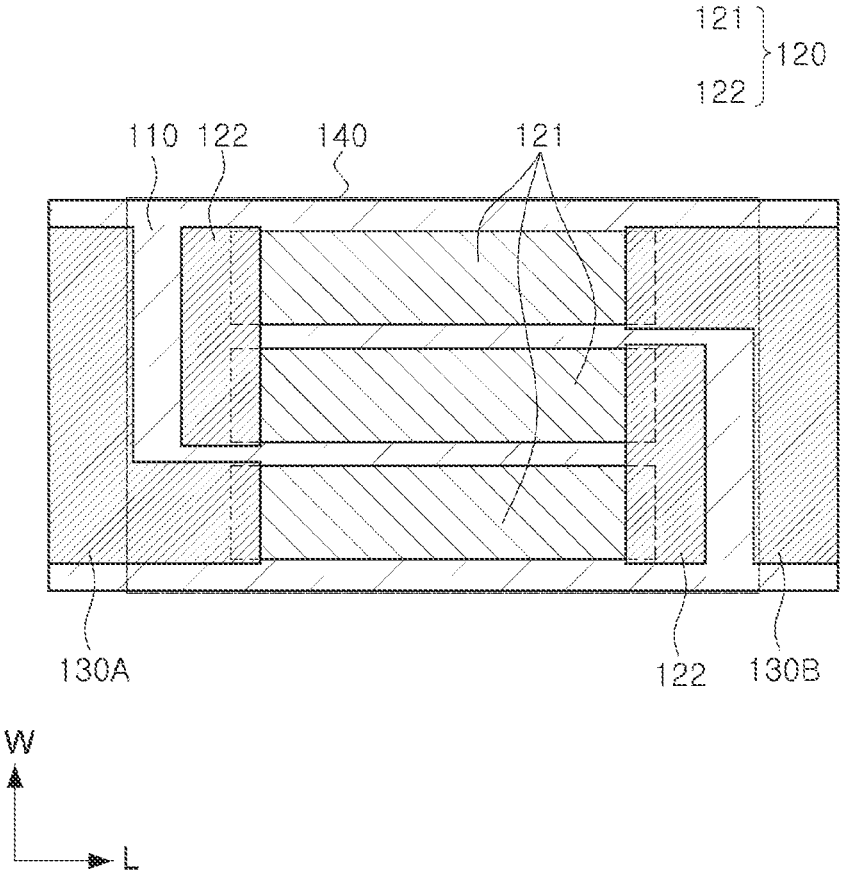

Next, referring to FIG. 5D, the protective layer 140 may be formed. The protective layer 140 may cover the resistor portion 120 and may further cover the insulating substrate 110. In addition, the protective layer 140 may further cover parts of the external electrodes 130A and 130B, but it may be preferable that the protective layer 140 does not cover regions of the external electrodes 130A and 130B connected to the cover electrodes 150A and 150B. As such, the protective layer 140 may be in contact with one side surface of an extending portion of each of the first and second cover electrodes 150A and 150B. Here, the extending portion of each of the first and second cover electrodes 150A and 150B may refer to a portion extending along the one surface of the insulating substrate 110.

Figure 5E:
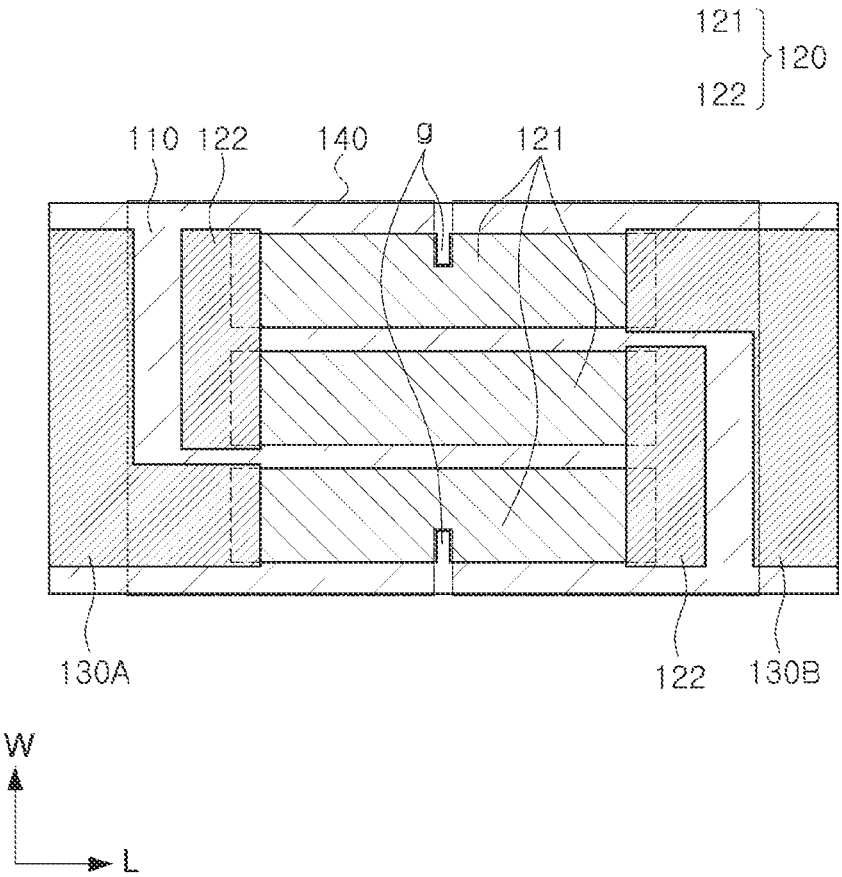

Next, referring to FIG. 5E, the groove g may be formed. The groove g may be formed through a trimming process using laser machining, and the resistance value of the resistor portion 120 may be finely adjusted through the groove. Specifically, the trimming process may be performed in a manner of measuring the resistance value of the resistor portion 120 while forming the groove g in the resistor body 121 and the protective layer 140 by laser machining or the like, and stopping the formation of the groove g when the resistance value reaches a target resistance value.

The groove g may be formed from the edge of each of the resistor body 121 and the protective layer 140 inwardly of each of the resistor body 121 and the protective layer 140. For example, the groove g may be formed from the edges of at least one of surfaces of each of the resistor body 121 and the protective layer 140 opposing each other in the width direction W inwardly of each of the resistor body 121 and the protective layer 140 in the width direction W. The groove g may penetrate through each of the resistor body 121 and the protective layer 140 in the thickness direction T. The groove g may not penetrate through each of the resistor body 121 and the protective layer 140 in the length direction L and the width direction W.

In this case, the resistor body 121 may be damaged in the trimming process, but the protective layer 140 may disposed on the resistor body 121 to significantly reduce the damage to the resistor body 121.

Although not illustrated in the drawings, the first cover electrode 150A and the second cover electrode 150B may further be formed using a plating process and a vapor deposition method such as sputtering alone or a combination thereof.

As set forth above, according to the exemplary embodiment in the present disclosure, the chip resistor having the excellent heat dissipation property and resistance to thermal shock may be provided.

In addition, the chip resistor having the improved electrical characteristics may be provided.

While exemplary embodiments have been shown and described above, it will be apparent to those skilled in the art that modifications and variations could be made without departing from the scope of the present invention as defined by the appended claims.

What is claimed is:

1. A chip resistor comprising:

an insulating substrate;

a resistor portion disposed on one surface of the insulating substrate, and including a plurality of resistor bodies spaced apart from each other in a width direction and a plurality of internal electrodes connecting the plurality of resistor bodies to each other; and a first external electrode and a second external electrode disposed on the one surface of the insulating substrate to be spaced apart from each other in a length direction perpendicular to the width direction and respectively connected to the resistor portion, wherein each of the plurality of resistor bodies has a first end adjacent to the first external electrode and a second end opposing the first end and adjacent to the second external electrode, each of the first end and the second end of each of the plurality of resistor bodies is connected to one of the plurality of internal electrodes, the first external electrode, or the second external electrode, at least one of the plurality of resistor bodies has a groove, and the groove extends from an edge, the edge extending in the length direction, of the at least one of the plurality of resistor bodies inwardly of the resistor body in the width direction.

2. The chip resistor of claim 1, wherein each of the first end and the second end of each of the plurality of resistor bodies is covered with one of the plurality of internal electrodes, the first external electrode, or the second external electrode.

3. The chip resistor of claim 1, wherein the plurality of internal electrodes include a same material as that of at least one of the first external electrode or the second external electrode.

4. The chip resistor of claim 1, wherein the plurality of resistor bodies are spaced apart from each other in a width direction perpendicular to a length direction in which the first end and the second end of each of the plurality of resistor bodies oppose to each other.

5. The chip resistor of claim 4, wherein the plurality of resistor bodies include a first resistor body and a second resistor body disposed at outermost sides in the width direction, the first resistor body is connected to the first external electrode, and the second resistor body is connected to the second external electrode.

6. The chip resistor of claim 5, wherein the first end and the second end of each of the plurality of resistor bodies, excluding the first resistor body and the second resistor body, are connected to the plurality of internal electrodes.

7. The chip resistor of claim 1, further comprising a protective layer disposed on the resistor portion.

8. The chip resistor of claim 7, wherein the groove extends to penetrate through the protective layer.

9. The chip resistor of claim 1, further comprising a first cover electrode and a second cover electrode disposed on end portions of the insulating substrate to be spaced apart from each other and connected to the first external electrode and the second external electrode, respectively.

10. The chip resistor of claim 9, wherein each of the first and second cover electrodes includes an extending portion extending along the one surface of the insulating substrate, a portion of the first external electrode is disposed between the insulating substrate and the extending portion of the first cover electrode, and a portion of the second external electrode is disposed between the insulating substrate and the extending portion of the second cover electrode.

11. The chip resistor of claim 9, further comprising a protective layer disposed on the resistor portion, wherein the protective layer entirely covers the plurality of resistor portions and the plurality of internal electrodes, and the protective layer partially covers parts of the insulating substrate and parts of the first and second external electrodes.

12. The chip resistor of claim 11, wherein the protective layer does not cover regions of the first and second external electrodes respectively connected to the first and second cover electrodes.

13. The chip resistor of claim 11, wherein each of the first and second cover electrodes includes an extending portion extending along the one surface of the insulating substrate, and the protective layer is in contact with one side surface of the extending portion of each of the first and second cover electrodes.

14. A chip resistor comprising:

an insulating substrate;

a resistor portion disposed on one surface of the insulating substrate, and including a plurality of resistor bodies spaced apart from each other and a plurality of internal electrodes connecting the plurality of resistor bodies to each other; and a first external electrode and a second external electrode disposed on the one surface of the insulating substrate to be spaced apart from each other and respectively connected to the resistor portion, wherein each of the plurality of internal electrodes covers parts of the plurality of resistor bodies, each of the plurality of internal electrodes connects adjacent resistor bodies to each other, and each of the plurality of internal electrodes has a portion extending along side surfaces of the adjacent resistor bodies perpendicular to the one surface of the insulating substrate.

15. The chip resistor of claim 14, wherein each of the plurality of internal electrodes covers end portions of the plurality of resistor bodies.

16. The chip resistor of claim 14, wherein at least one of the plurality of resistor bodies has a groove, and the groove extends from an edge of the at least one of the plurality of resistor bodies inwardly of the resistor body.

17. The chip resistor of claim 14, wherein each of the plurality of internal electrodes extends from the portion extending along the side surface of the internal electrodes and is bent to cover the parts of the plurality of resistor bodies.

18. A chip resistor comprising:

an insulating substrate;

a resistor portion disposed on one surface of the insulating substrate, and including a plurality of resistor bodies spaced apart from each other in a width direction and a plurality of internal electrodes each connecting adjacent resistor bodies of the plurality of resistor bodies to each other; and a first external electrode and a second external electrode disposed on the one surface of the insulating substrate and connected to two outermost resistor bodies of the plurality of resistor bodies, respectively, in a length direction perpendicular to the width direction, wherein the first external electrode and the second external electrode extend in opposite directions, parallel to the length direction, from respective ends of the two outermost resistor bodies, and further extend in opposite directions, parallel to the width direction, along opposing edges of the insulating substrate, such that the first external electrode and the second external electrode overlap the plurality of internal electrodes in the length direction.

19. The chip resistor of claim 18, wherein each of the plurality of internal electrodes and each of the first and second external electrodes overlap the plurality of resistor bodies in a thickness direction, perpendicular to the width and length directions.

20. The chip resistor of claim 18, wherein the plurality of internal electrodes include a same material as that of at least one of the first external electrode or the second external electrode.

* * * * *